US010003893B2

(12) United States Patent
Kamkar-Parsi

(10) Patent No.: US 10,003,893 B2
(45) Date of Patent: Jun. 19, 2018

(54) METHOD FOR OPERATING A BINAURAL HEARING SYSTEM AND BINAURAL HEARING SYSTEM

(71) Applicant: SIVANTOS PTE. LTD., Singapore (SG)

(72) Inventor: Homayoun Kamkar-Parsi, Erlangen (DE)

(73) Assignee: Sivantos Pte. Ltd., Singapore (SG)

( * ) Notice: Subject to any disclaimer, the term of this patent is extended or adjusted under 35 U.S.C. 154(b) by 0 days. days.

(21) Appl. No.: 15/611,825

(22) Filed: Jun. 2, 2017

(65) Prior Publication Data

US 2017/0353804 A1 Dec. 7, 2017

(51) Int. Cl.
*H04R 5/00* (2006.01)
*H04R 25/00* (2006.01)

(52) U.S. Cl.
CPC ..... *H04R 25/407* (2013.01); *H04R 25/552* (2013.01); *H04R 2225/41* (2013.01); *H04R 2430/20* (2013.01)

(58) Field of Classification Search
CPC ..... H04R 25/407; H04R 25/552; H04R 2225/41; H04R 2430/20
USPC ..... 381/23.1, 26, 94.1, 71.11, 92
See application file for complete search history.

(56) References Cited

U.S. PATENT DOCUMENTS 4,956,867 A * 9/1990 Zurek ..... H04R 3/005 381/71.11
5,651,071 A * 7/1997 Lindemann ..... H04R 25/552 381/314
2001/0031053 A1* 10/2001 Feng ..... H04R 25/407 381/92
2004/0196994 A1* 10/2004 Kates ..... H04R 25/407 381/320
2004/0252852 A1* 12/2004 Taenzer ..... H04R 3/005 381/119
2005/0069162 A1* 3/2005 Haykin ..... H04R 25/407 381/312
2009/0304203 A1* 12/2009 Haykin ..... G10L 21/02 381/94.1

(Continued)

OTHER PUBLICATIONS

Mowlaee ,Peyman, et al.: "Advances in phase-aware signal processing in speech communication". Speech communication, elsevier science publishers, Amsterdam, NL, vol. 81, May 9, 2016.

(Continued)

*Primary Examiner* — David Ton
*Assistant Examiner* — Friedrich W Fahnert
(74) *Attorney, Agent, or Firm* — Laurence A. Greenberg; Werner H. Stemer; Ralph E. Locher

(57) ABSTRACT

In a method for operating a binaural hearing system having a first hearing aid and a second hearing, the first hearing aid generates a first reference signal from a sound signal by a first reference microphone and the second hearing aid generates a second reference signal from the sound signal by a second reference microphone. The first reference signal and the second reference signal are both used to derive a first binaural beamformer signal. For at least a number of frequency bands, the first reference signal is used to derive a first phase. For the number of frequency bands, a first output signal is derived from the first binaural beamformer signal and the first phase.

11 Claims, 3 Drawing Sheets

(56) References Cited

U.S. PATENT DOCUMENTS

2016/0081623 A1* 3/2016 Lunner ..... A61B 5/6817
381/315

OTHER PUBLICATIONS

Welker, Daniel P. , et al.: "Microphone-Array Hearing Aids with Binaural Output—Part II: A Two-Microphone Adaptive System". Nov. 1, 1997 (Nov. 1, 1997), XP011054279, ISSN: 1063-6676.
Jeub Marco, et al.: "Model-Based Dereverberation Preserving Binaural Cues". Sep. 1, 2010 (Sep. 1, 2010), pp. 1732-1745, ISSN: 1558-7916.

* cited by examiner

METHOD FOR OPERATING A BINAURAL HEARING SYSTEM AND BINAURAL HEARING SYSTEM

CROSS-REFERENCE TO RELATED APPLICATION

This application claims the priority, under 35 U.S.C. § 119, of European application EP 16 172 906.6, filed Jun. 3, 2016; the prior application is herewith incorporated by reference in its entirety.

BACKGROUND OF THE INVENTION

Field of the Invention

The invention relates to a method for operating a binaural hearing system. The binaural hearing system contains a first hearing aid and a second hearing aid. Wherein in the first hearing aid, a first reference signal is generated from a sound signal by first reference microphone, and in the second hearing aid, a second reference signal is generated from the sound signal by a second reference microphone. The first reference signal and the second reference are both used to derive a binaural beamformer signal. The invention further relates to a binaural hearing system, comprising a first hearing aid and a second hearing aid and a signal processor, the signal processor being configured to perform such a method.

The current state of the art binaural beamformers can provide noise reduction and preserve efficiently the binaural cues of the target speaker. Binaural cues enclose all the acoustical information available to both ears of a listener for localizing a sound source. Now for an application in a binaural beamformer in which noise reduction is performed via the beamforming, the binaural cues of the target source are typically preserved, as the beamforming enhances sound from this direction. However, the typical sound environment does also comprise residual noise, which is to be reduced by the noise reduction, so that the binaural cues of the residual noise may be distorted. In particular, this may happen independently of whether the residual noise of the sound environment being a directional noise source or a superposition of few directional noise sources, or diffuse background noise. The distortion of the binaural cues of the residual noise causes a negative impact on the perception of the resulting acoustic scene.

The current state of the art solutions to this problem typically require information which may not be available neither measureable in real time applications. E.g., a solution based on the multi-channel Wiener filter requires a knowledge of statistics of the noise signals, which due to the presence of the target signals may not be available neither open to estimation. Likewise, solutions employing the interaural transfer functions assuming that for the type of noise present, the interaural transfer function is available, which in dynamic acoustic environments also is very often not the case. Another class of proposed solutions preserves the binaural cues of the noise as well as the target by applying a single real valued scalar common gain to each of the reference microphones on both sides of a hearing aid or a hearing system in order to produce the binaural outputs. However, the noise reduction is significantly reduced compared to normal beamforming methods.

SUMMARY OF THE INVENTION

It is therefore an object of the invention to find a method for operating a binaural hearing system, which permits the performance of noise reduction while still preserving as much as possible the binaural cues of the residual noise in the presence of a target sound signal. The method shall preferably achieve the object with no restrictions on the acoustic environment or on a signal-to-noise-ratio (SNR).

According to the invention the object is achieved by a method for operating a binaural hearing system. The binaural hearing system contains a first hearing aid and a second hearing aid. In the first hearing aid, a first reference signal is generated from a sound signal by a first reference microphone, and in the second hearing aid, a second reference signal is generated from the sound signal by a second reference microphone. The first reference signal and the second reference signal are both used to derive a first binaural beamformer signal. Wherein for at least a number of frequency bands, the first reference signal is used to derive a first phase, and for the number of frequency bands, a first output signal is derived from the first binaural beamformer signal and the first phase. Embodiments of particular advantage are given in the dependent claims and the description following below.

The notion of a first reference microphone, or a second reference microphone, respectively, shall comprise any type of sound transducer which is set up to and capable to receive an acoustical wave pattern and to transduce the acoustical wave pattern into an electrical signal. The notion of a first binaural beamformer signal in particular shall comprise a signal with non-trivial spatial sensitivity characteristics. I.e., for a given probe generating a fixed sound pressure level and the probe reference sound source being located in a far field at a fixed distance with respect to the distance between the first reference microphone and the second reference microphone, the binaural beamformer signal may in particular show a varying signal level for the probe reference sound generator varying its angular position with respect to the assembly of the first reference microphone and the second reference microphone. To this end, the first reference signal and the second reference signal in particular may be combined as linear combinations with different gain factors and possibly a delay between the two mentioned signals.

The spatial characteristics of the first binaural beamformer signal may vary over different frequency bands of the binaural hearing system. The number of frequency bands, for which the first reference signal is used to derive a first phase, the first phase entering in the first output signal of each of the respective frequency bands, may depend on the implemented frequency decomposition given by a particular filtering process which is applied to the first reference signal and to the second reference signal, preferably in the same manner. The total number and mutual overlap of frequency bands may depend on the particular decomposition or filtering process employed.

Typically, the human hearing localizes a sound source mainly based on its binaural cues, encoded mostly in the interaural time difference and the interaural level differences of the sound signal which has propagated from the sound source to each of the two ears. Interaural time differences are caused by the different propagation times of a sound wave from the source to both ears. Interaural level differences are mainly caused by the acoustic shadow of the head. For example, from a sound source to the left, the sound wave will reach the left ear slightly before it reaches the right ear, resulting in a phase difference, while the sound wave will arrive at the left ear with a slightly higher level than at the right ear due to the shadowing effect of the head of the listener.

The beamforming process in generating the first binaural beamformer signal will typically result in a loss of both the proper time relation and the proper level relation of the two hearings with respect to a given sound signal, since a delay and different gain factors may be applied to the first reference signal and the second reference signal for beamforming. For one target sound signal, the beamformer is typically directed towards the location of the target sound signal source, and thus the proper binaural cues may be reconstructed, at least in an approximation. In order to reconstruct the binaural cues of a sound signal whose source is not located in the target direction of a beamformer, the invention as a first approximation and for simplicity takes into account only the temporal information while neglecting information given in the level difference of a sound signal arriving at the two hearings, since the latter information in the context of binaural hearing systems may be more difficult to obtain.

In order to have a binaural hearing system which can react quickly on changing sound conditions and may operate in real time as much as possible, the temporal information for reconstructing the binaural cues of the non-target sound signals shall be taken from the phase information of the sound signal at only one side of the binaural hearing system. To this end, the frequency of the sound signal in particular may be approximated as static over a short period of time, such the phase of the sound signal may be extracted directly from the oscillations given in the first reference signal. Preferably, the first reference microphone generating the first reference signal is located at that side of the binaural hearing system to which the first output signal is supplied to. In an easy way, the temporal information of a non-target sound signal which would normally be encoded in a time shift between the two hearings is approximated by a phase from the first reference signal and fed into the first output signal along with the first binaural beamformer signal, such that the first phase may help restoring binaural cues from the non-target sound signal, and the binaural beamformer signal showing the desired noise reduction properties in its amplitudes.

Preferably, at least for a number of the frequency bands in which the first reference signal is used to derive a first phase and the first output signal is derived from the first binaural beamformer signal and the first phase, is entirely below 2 kHz, most preferably below 1.5 kHz. In general, most of the acoustic energy and thus, of first and the second reference signals' energy as well, is concentrated at lower frequencies of the human acoustical spectrum. Therefore, it may be a reasonable assumption that the spatial perception of an acoustical environment by a listener, especially in a complex situation as a multi-talker or conversation hearing situation, might be dominated by the signal contributions in the lower frequency range.

It is a known fact in psychoacoustics that at low frequencies, in particular below 2 kHz, the interaural phase differences—i.e., time shifts—are more relevant than interaural sound signal level differences. Thus, the information loss when neglecting the information given in the level differences can be considered small in comparison to the total relevant information gain by applying the first phase in at least the proper frequency bands, and therefore does not affect the restoring of the binaural cues in a critical way while still keeping the process complexity as low as possible by neglecting the level differences.

For a preferred embodiment, in the number of frequency bands, the first binaural beamformer signal is decomposed into its magnitude and phase components, and the first output signal is derived using the magnitude component of the first binaural beamformer signal and the first phase. This is a particularly efficient way to preserve the desired noise reduction properties of the first binaural beamformer signal while restoring the binaural cues via the first phase.

Hereby, in the number of frequency bands, preferably the magnitude component of the first output signal is given by the magnitude component of the first binaural beamformer signal, and the phase component of the first output signal is given by the first phase. This is a particularly fast-to-calculate way to apply the temporal information encoded in the first phase to the first binaural beamformer signal.

For another preferred embodiment, in the first hearing aid, a first supplementary signal is generated from the sound signal by a first supplementary microphone. The notion of a first supplementary microphone shall comprise any type of sound transducer which is set up to and capable to receive an acoustical wave pattern and to transduce the acoustical wave pattern into an electrical signal. In modern binaural hearing systems and in particular, binaural hearing aids, for a better spatial sound perception more than just one microphone in a single hearing aid may be employed. The use of more than one microphone at one side, in combination with the microphone or microphones from the other side allows for a better beamforming, i.e., a narrower directionality if required or a better signal-to-noise-ratio in beamforming noise reduction. In particular, the first supplementary microphone is located within the first hearing aid slightly apart from the first reference microphone in order to be able to detect small time shifts with respect to the first reference microphone when a propagating sound signal impinges on the first hearing aid.

Preferably, the first reference signal and the first supplementary signal are used to derive the first phase. In doing so, a higher amount of spatial information about the propagating sound signal may be included in the first phase, as the use of both the first reference signal and the first supplementary signal for deriving the first phase allow for an at least implicit inference about a direction of the sound signal's source. This direction information can be included—at least, implicitly—in the first phase which helps to improve the preservation or restoring of the binaural cues of non-target signals.

In yet another preferred embodiment, from the first reference signal and from the first supplementary signal, a first pre-processed signal is derived, and in the number of frequency bands, the first phase is given by the phase of the first pre-processed signal. The pre-processing of the first reference signal and the first supplementary signal may comprise noise reduction, which may be directional. In particular, the noise reduction present in the first pre-processing may attenuate sounds from a back hemisphere of a user of the binaural hearing system, such that sounds from a frontal hemisphere are enhanced in the first pre-processed signal. This takes into account that in a typical conversation, the view of a speaker is directed towards his interlocutor, and thus, the target source, so that diffuse babble as well as speakers outside the view angle are attenuated in the first output signal.

Hereby it is of particular advantage to use the first pre-processed signal in order to obtain the first binaural beamformer signal. In case the first pre-processed signal is taken to be the main signal component from the first hearing aid to enter the first binaural beamformer signal, i.e., if the binaural beamforming for obtaining the first binaural beamformer signal receives only the first pre-processed signal as an input but neither the first reference signal nor the first supplementary signal as its individual components, then a good phase reference from the first hearing aid to restore binaural cues is given by the phase of the first pre-processed signal.

Furthermore, in order preserve the phase information contained in both the first reference signal and the first supplementary signal, when applying a monaural noise reduction, taking the first phase as the phase of the first pre-processed signal is especially useful, as noise to be reduced in the pre-processing for the first pre-processed signal—such as the mentioned talk contributions from speakers in the back hemisphere of the user of diffuse babble in the back hemisphere—are not taken into account for the first phase.

Preferably, in the second hearing aid, a second supplementary signal is generated from the sound signal by a second supplementary microphone. The notion of a second supplementary microphone shall comprise any type of sound transducer which is set up to and capable to receive an acoustical wave pattern and to transduce the acoustical wave pattern into an electrical signal. The presence of a second supplementary signal allows for a more symmetrical treatment of the two hearing aids. In particular, the first output signal may be supplied to one hearing via a first loudspeaker or, more generally, by a first sound generator of any kind, while a second output signal may be supplied to the other hearing by a second loudspeaker or a second sound generator. Hereby, the first output signal is generated in the way described above from the first binaural beamformer signal, which in turn is generated employing at least the first supplementary signal, while the second output signal may be generated from a second binaural beamformer signal in a similar way, the second binaural beamfromer signal employing then at least the second supplementary signal.

Preferably, from the second reference signal and from the second supplementary signal, a second pre-processed signal is derived. The pre-processing of the second reference signal and the second supplementary signal may comprise noise reduction, which may be directional. In particular, the noise reduction present in the second pre-processing may attenuate sounds from the back hemisphere of the user of the binaural hearing system, such that sounds from the frontal hemisphere are enhanced in the second pre-processed signal. Pre-processing the second reference signal and the second supplementary signal and deriving a second pre-processed signal due to the symmetry reasons mentioned above is especially useful when a first pre-processed signal is derived from the first reference signal and from the first supplementary signal.

It is of particular advantage to use the second pre-processed signal in order to obtain the first binaural beamformer signal. In case the first pre-processed signal is taken to be the main signal component from the first hearing aid to enter the first binaural beamformer signal, i.e., if the binaural beamforming for obtaining the first binaural beamformer signal receives only the first pre-processed signal as an input but neither the first reference signal nor the first supplementary signal as its individual components, due to symmetry reasons it is useful to treat the second reference signal and the second supplementary signal in a similar way, i.e., by pre-processing, and to use the second pre-processed signal for the first binaural beamformer signal.

Furthermore, in the pre-processing step leading to the first pre-processed signal and the second pre-processed signal, respectively, one may perform a monaural noise reduction, in particular for attenuating the sound coming from the back hemisphere of the user of the binaural hearing system. Then, the first binaural beamformer signal is obtained from the first pre-processed signal and the second pre-processed signal, allowing for a sharp beamforming in the frontal hemisphere of the user and a high degree of directionality, and thus, binaural noise reduction. In order to maintain the proper spatial perception of signal components in that frontal hemisphere which are attenuated by the binaural noise reduction—e.g., sound from non-target speakers—the first phase as a phase reference for phase of the output signal is preferably taken as the phase of the first pre-processed signal.

Another aspect of the invention is given by a binaural hearing system, containing a first hearing aid and a second hearing aid and a signal processor, the signal processor being configured to perform the method described above. The advantages of the proposed method for operating a binaural hearing system and for its preferred embodiments can be transferred to the binaural hearing system itself in a straight forward manner.

Other features which are considered as characteristic for the invention are set forth in the appended claims.

Although the invention is illustrated and described herein as embodied in a method for operating a binaural hearing system, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DETAILED DESCRIPTION OF THE INVENTION

Figure 1:
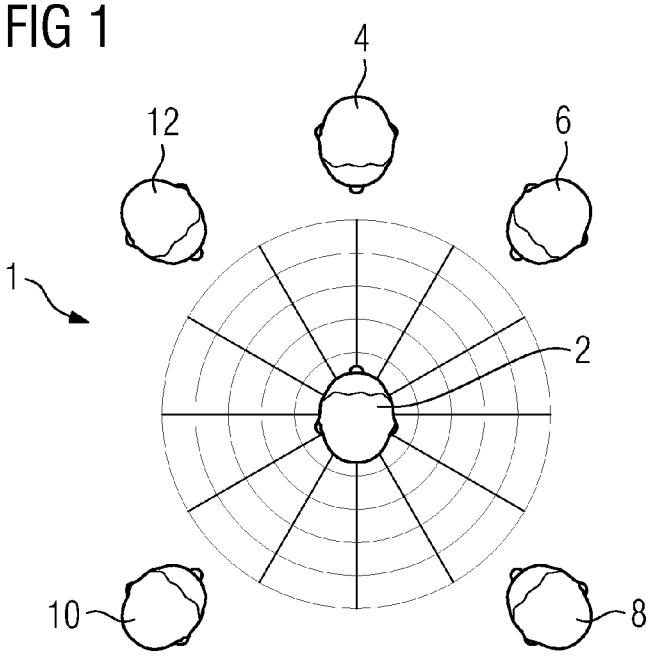
FIG. 1 is schematical top view of a conversation hearing situation including a user of a state of the art binaural hearing system and five speakers.

Parts and variables corresponding to one another are provided with in each case the same reference numerals in all figures.

Referring now to the figures of the drawings in detail and first, particularly to FIG. 1 thereof, there is shown a schematical top view of a hearing situation 1 corresponding to a conversation is shown. A user 2 of a non-illustrated state-of-the-art binaural hearing system is surrounded by his conversational partners, given by speakers 4, 6, 8, 10, 12, while directing his view towards the target speaker 4 for a given moment.

If the state-of-the-art binaural hearing system is applying noise reduction in which noise from directions other than the one of the target speaker 4, at least partially, is aimed to be reduced via the binaural beamforming of the binaural beamforming system, the target speaker 4 will be perceived by the user 2 in the proper direction. However, the other, non-target speakers 6, 8, 10, 12, apart from having an attenuated signal volume in the output signal of the binaural beamforming hearing aid as perceived by the user 2, due to the binaural beamforming may show their binaural cues distorted when talking to the user 2 which is focused on the target speaker 4, leading to an improper perception of the acoustical localization of the non-target speakers 6, 8, 10, 12 in the perception of the user 2.

Figure 2:
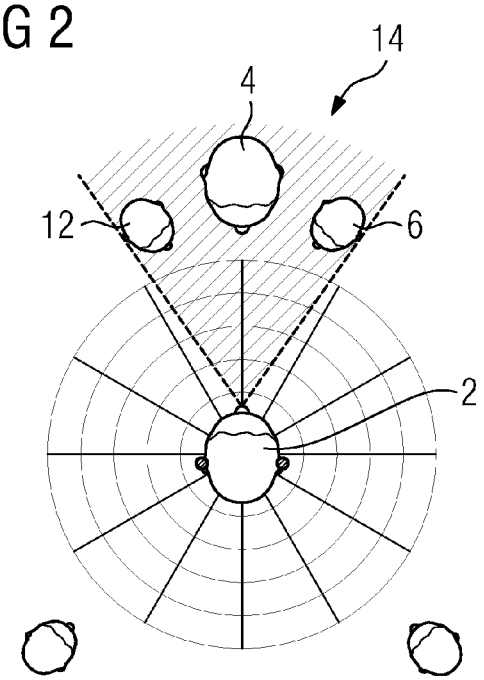
FIG. 2 is a schematical top view of the conversation hearing situation according to FIG. 1, as well as an acoustical localization of the speakers as perceived by the user of the binaural hearing system.

This is displayed schematically in FIG. 2. The attenuation of the signal volume of—possibly occasional—conversational contributions of the non-target target speakers 6, 8, 10, 12 with respect to the signal volume of the contributions of the target speaker 4 in the output signal of the binaural hearing system is displayed by a miniaturization of the non-target speakers 6, 8, 10, 12 compared to FIG. 1. The loss of the binaural cues may lead to a wrong acoustical perception of the positions of the non-target speakers 6, 8, 10, 12 by the user 2. This means, the user 2 can see the actual positions of two intervening non-target speakers 6, 12 as spatially well separated from the target speaker 4, but due to the state-of-the-art binaural beamforming, displayed by the beam 14, and the loss of binaural cues of the non-target speakers 6, 12 caused by the noise reduction processes, the user 2 "hears" contributions from the non-target speakers 6, 12 as if those were located much closer to the target speaker 4.

Figure 3:
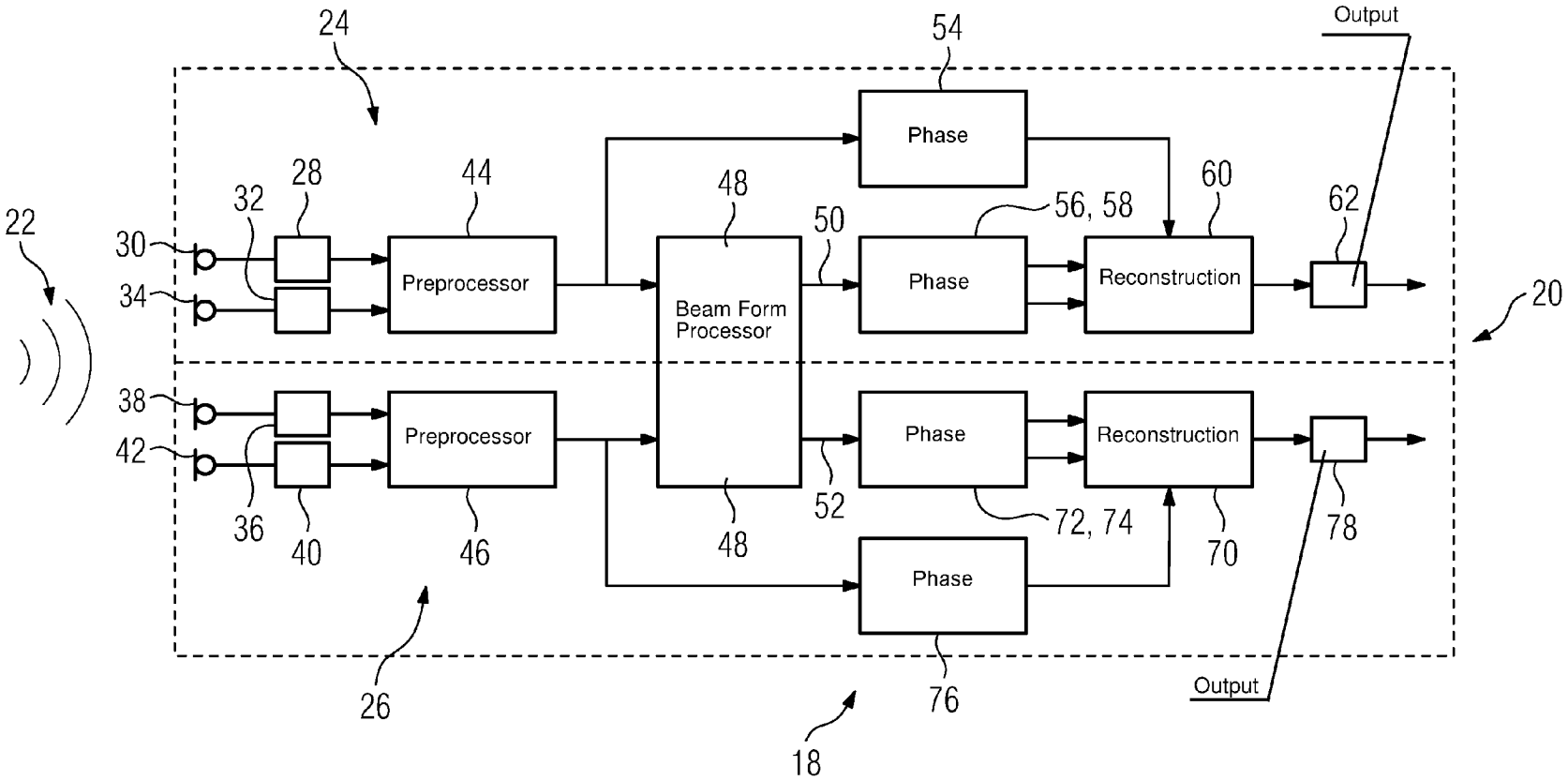
FIG. 3 is a block diagram of a method for operating a binaural hearing system in order to preserve perception of binaural cues when noise reduction is active.

In FIG. 3, a method 18 for operating a binaural hearing system 20 is illustrated by means of a block diagram. The method 18 is particularly useful in order to preserve binaural cues of a sound signal 22 when noise reduction is active in the binaural hearing system 20. The binaural hearing system 20 has a first hearing aid 24 and a second hearing aid 26. In the first hearing aid 24, a first reference signal 28 is generated from the sound signal 22 by a first reference microphone 30, while a first supplementary signal 32 is generated from the sound signal 22 by a first supplementary microphone 34. In the second hearing aid 26, a second reference signal 36 is generated from the sound signal 22 by a second reference microphone 38, while a second supplementary signal 40 is generated from the sound signal 22 by a second supplementary microphone 42. From the first reference signal 28 and the first supplementary signal 32, a first pre-processed signal 44 is generated, employing pre-processing such as, e.g., frequency band filtering, monaural noise reduction and feedback cancellation. The exact pre-processing techniques applied in order to obtain the first pre-processed signal 44 from the first reference signal 28 and the first supplementary signal 32 may vary over different frequency bands. From the second reference signal 36 and the second supplementary signal 40, a second pre-processed signal 46 is generated in a similar way.

Now in both the first hearing aid 24 and the second hearing aid 26, a binaural beamforming process 48 is preformed, taking for each hearing aid the first pre-processed signal 44 and the second pre-processed signal 46 as bandwise input signals, and generating a first binaural beamformer signal 50 in the first hearing aid 24 and a second binaural beamformer signal 52 in the second hearing aid 52, respectively. The first and the second binaural beamformer signal 50, 52 each may show a spatial characteristics determined by signal components of all of the first and second reference and supplementary signals, thus opening the way to a very efficient noise reduction and speaker enhancement by a narrow beamforming. The spatial characteristics for the first binaural beamformer signal 50 may vary over different frequency bands, and likewise for the second binaural beamformer signal 52.

Thus, the first and second binaural beamformer signals 50, 52, respectively, may show a very good SNR for a given target signal, as well as a very well defined, narrow beam. However, for non-target sound signals whose sound source lies outside of the beam's direction, the beamforming distorts the binaural cues such that the spatial location of the non-target sound source would be perceived wrong by the user 2 of the binaural hearing system 20, e.g. closer to the target sound source, as described in FIG. 2. To this end, the binaural cues are restored by the method 18 before generating an output signal that is output by a loudspeaker of a hearing aid.

In the first hearing aid 24, a first phase 54 is tapped off from the first pre-processed signal 44. The first binaural beamformer signal 50 is decomposed into its magnitude 56 and its phase 58, and for certain frequency bands, preferably for at least a number of frequency bands below 2 kHz, the phase 58 of the first binaural beamformer signal 50 is substituted by the first phase 54. For other frequency bands, in particular for at least some bands above 2 kHz, no such substitution is performed. After the reconstruction 60 of the binaural cues by plugging the first phase 54—given by the phase of the first pre-processed signal 44—into the first binaural beamformer signal 50 in the corresponding frequency bands while maintaining the magnitude 56 of the first binaural beamformer signal 50, the resulting signal of the reconstruction 60 is defined as a first output signal 62. The first output signal 62 may be treated by applying further non-directional sound processing (not shown) before outputting it via some first loudspeaker (not shown) of the first hearing aid 24 to one hearing of the user 2. For some frequency bands, in particular frequency bands above 2 kHz, the reconstruction 60 may not be necessary, and the first output signal 62 may directly be given by the first binaural beamformer signal 50.

The reconstruction 70 of the binaural cues in the second hearing aid 26 is performed in a similar way to the reconstruction 60 in the first hearing aid 24. The second binaural beamformer signal 52 is decomposed into its phase 72 and its magnitude 74, and a second phase 76 is extracted from the second pre-processed signal 46. In at least a number of frequency bands—some of them preferably below 2 kHz—the second phase 76 is plugged into the decomposition of the second binaural beamformer signal 52, substituting the phase 72 of the latter. The second output signal 78 in the corresponding frequency bands in which the reconstruction 70 is performed is given by the magnitude 74 of the second binaural beamformer signal 52 with the second phase 76.

For the first output signal, when restoring the binaural cues via the reconstruction 60, the phase information for the first output signal 62 is entirely extracted from the first pre-processed signal 44, and thus, entirely determined by the phase of the sound signal 22 at the first hearing aid 24. On the one hand, a noise reduction process which is based on a binaural beamforming process suppressing sounds from sound sources located in different directions than the target sound source may distort the binaural cues of non-target sound signals, i.e., sound signal components whose source is not located in the target direction. Even though these sound signals are suppressed by the binaural beamforming anyway, and might not be perceived as "conversationally relevant", they still might have an important impact on the user's 2 perception of the acoustical scene in his hearing environment. Distorted binaural cues of these non-target sound signals then may lead to a mismatch of the acoustical perception of the non-target sound sources and their actual positions as seen by the user. The phase information taken from one hearing aid as the phase in that hearing aid's output signal allows the user 2 to perceive the proper temporal shiftings and delays in order to restore binaural cues.

Figure 4:
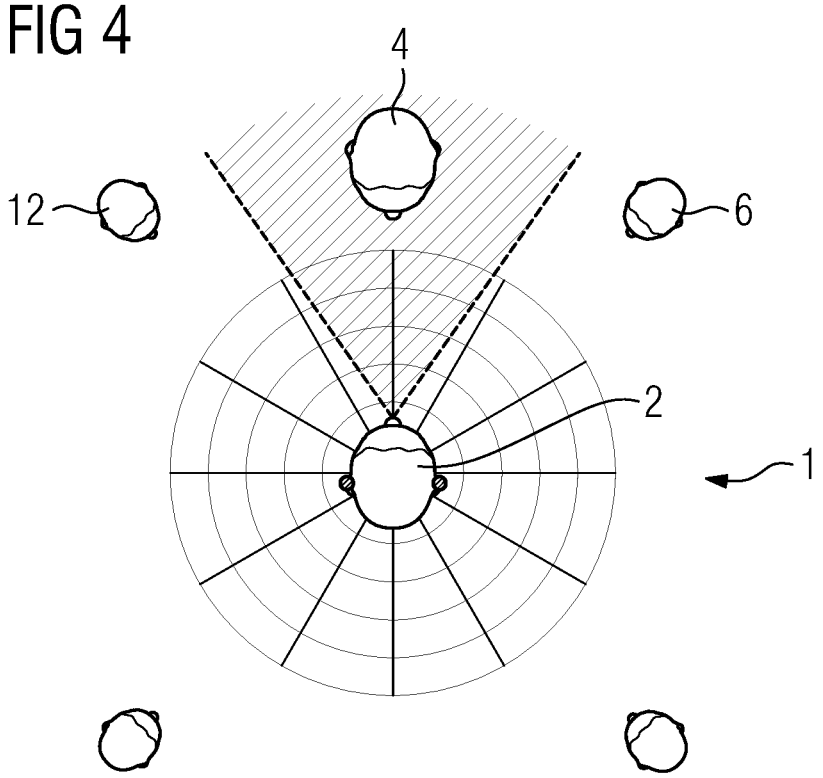
FIG. 4 is a schematical top view of the conversation hearing situation given in FIG. 1, as well as the acoustical localization of the speakers as perceived by the user of the binaural hearing system when applying the method according to FIG. 3.

Thus, as schematically shown in FIG. 4 in a top view of the hearing situation 1 given in FIG. 1, the user 2 now acoustically locates the non-target speakers 6, 12 in the same position with respect to the target speaker 4 as he sees them.

Even though the invention has been illustrated and described in detail with help of a preferred embodiment example, the invention is not restricted by this example. Other variations can be derived by a person skilled in the art without leaving the extent of protection of this invention.

The following is a summary list of reference numerals and the corresponding structure used in the above description of the invention:

1 hearing situation
2 user (of a binaural hearing system)
4 target speaker
6-12 non-target speakers
14 beam
18 method for operating a binaural hearing system
20 binaural hearing system
22 sound signal
24 first hearing aid
26 second hearing aid
28 first reference signal
30 first reference microphone
32 first supplementary signal
34 first supplementary microphone
36 second reference signal
38 second reference microphone
40 second supplementary signal
42 second supplementary microphone
44 first pre-processed signal
46 second pre-processed signal
48 binaural beamforming process
50 first binaural beamformer signal
52 second binaural beamformer signal
54 first phase
56 magnitude of the first binaural beamformer signal
58 phase of the first binaural beamformer signal
60 reconstruction
62 first output signal
70 reconstruction
72 phase of the second binaural beamformer signal
74 magnitude of the second binaural beamformer signal
76 second phase
78 second output signal

The invention claimed is:

1. A method for operating a binaural hearing system, the binaural hearing system having a first hearing aid and a second hearing aid, which comprises the steps of:

generating in the first hearing aid, a first reference signal, from a sound signal received by a first reference microphone;

generating in the second hearing aid, a second reference signal, from the sound signal received by a second reference microphone;

using both the first reference signal and the second reference signal to derive a first binaural beamformer signal;

decomposing the first binaural beamformer signal into its magnitude and phase components in a number of frequency bands;

using the first reference signal to derive a first phase for at least the number of frequency bands; and deriving a first output signal from the magnitude component of the first binaural beamformer signal and the first phase for the number of frequency bands.

2. The method according to claim 1, which further comprises:

using both the first reference signal and the second reference signal to derive a second binaural beamformer signal;

using the second reference signal to derive a second phase for at least a further number of frequency bands; and deriving a second output signal from the second binaural beamformer signal and the second phase for the further number of frequency bands.

3. The method according to claim 1, wherein in the number of frequency bands, a magnitude component of the first output signal is given by the magnitude component of the first binaural beamformer signal, and a phase component of the first output signal is given by the first phase.

4. The method according to claim 1, which further comprises generating a first supplementary signal from the sound signal received by a first supplementary microphone in the first hearing aid.

5. The method according to claim 1, which further comprises generating in the second hearing aid, a second supplementary signal from the sound signal received by a second supplementary microphone.

6. The method according to claim 5, which further comprises deriving from the second reference signal and from the second supplementary signal, a second pre-processed signal.

7. The method according to claim 6, which further comprises using the second pre-processed signal for obtaining the first binaural beamformer signal.

8. A method for operating a binaural hearing system, the binaural hearing system having a first hearing aid and a second hearing aid, which comprises the steps of:

generating in the first hearing aid, a first reference signal, from a sound signal received by a first reference microphone;

generating in the second hearing aid, a second reference signal, from the sound signal received by a second reference microphone;

generating a first supplementary signal from the sound signal received by a first supplementary microphone in the first hearing aid;

using both the first reference signal and the second reference signal to derive a first binaural beamformer signal;

using the first reference signal and the first supplementary signal to derive a first phase for at least a number of frequency bands; and deriving a first output signal from the first binaural beamformer signal and the first phase for the number of frequency bands.

9. The method according to claim 8, wherein:

from the first reference signal and from the first supplementary signal, a first pre-processed signal is derived; and in the number of frequency bands, the first phase is given by a phase of the first pre-processed signal.

10. The method according to claim 9, which further comprises using the first pre-processed signal for obtaining the first binaural beamformer signal.

11. A binaural hearing system, comprising:

a first hearing aid having a first reference microphone;

a second hearing aid having a second reference microphone; and a signal processor programmed to:

generate in said first hearing aid, a first reference signal, from a sound signal received by said first reference microphone;

generate in said second hearing aid, a second reference signal, from the sound signal received by said second reference microphone;

use both the first reference signal and the second reference signal to derive a first binaural beamformer signal;

decomposing the first binaural beamformer signal into its magnitude and phase components in a number of frequency bands;

use the first reference signal to derive a first phase for at least the number of frequency bands; and derive a first output signal from the magnitude component of the first binaural beamformer signal and the first phase for the number of frequency bands.

* * * * *